US009718578B1

(12) United States Patent
Smith

(10) Patent No.: US 9,718,578 B1
(45) Date of Patent: Aug. 1, 2017

(54) CONTAINERS WITH ROLLOVER SIDE WALLS AND REINFORCED CORNERS

(71) Applicant: WestRock Shared Services, LLC, Norcross, GA (US)

(72) Inventor: Kenneth C. Smith, Hiram, GA (US)

(73) Assignee: WestRock Shared Services, LLC, Norcross, GA (US)

( * ) Notice: Subject to any disclaimer, the term of this patent is extended or adjusted under 35 U.S.C. 154(b) by 0 days.

(21) Appl. No.: 15/009,671

(22) Filed: Jan. 28, 2016

(51) Int. Cl.

| | |
|---|---|
| ***B65D 43/00*** | (2006.01) |
| ***B65D 5/44*** | (2006.01) |
| ***B65D 5/20*** | (2006.01) |
| ***B65D 5/64*** | (2006.01) |
| ***B65D 5/42*** | (2006.01) |
| ***B31B 3/26*** | (2006.01) |

(52) U.S. Cl.
CPC ..... *B65D 5/443* (2013.01); *B31B 3/26* (2013.01); *B65D 5/20* (2013.01); *B65D 5/4279* (2013.01); *B65D 5/64* (2013.01); *B31B 2203/066* (2013.01); *B31B 2203/105* (2013.01)

(58) Field of Classification Search
CPC ..... B65D 5/443; B65D 5/20; B65D 5/4279; B65D 5/64; B65D 5/22; B65D 5/002; B65D 5/0045; B31B 3/26
USPC ..... 229/125.01, 186, 190, 191, 122.32, 918, 229/117.17, 174, 915, 108, 109, 179, 170, 229/177, 185.1
See application file for complete search history.

(56) References Cited

U.S. PATENT DOCUMENTS

| | | | | |
|---|---|---|---|---|
| 2,986,320 | A * | 5/1961 | Nicholls | B65D 5/002 229/117.16 |
| 3,055,573 | A * | 9/1962 | Carter | B65D 5/002 229/117.16 |
| 4,417,686 | A | 11/1983 | Wozniacki | |
| 4,676,429 | A | 6/1987 | Crowe et al. | |
| 4,792,084 | A | 12/1988 | Dreeszen | |
| 4,948,033 | A | 8/1990 | Halsell, II et al. | |
| 5,125,568 | A | 6/1992 | Bauer | |
| 5,285,956 | A | 2/1994 | Piepho | |
| 5,452,848 | A | 9/1995 | Mur Gimeno | |
| 5,458,283 | A | 10/1995 | Southwell et al. | |
| 5,535,941 | A | 7/1996 | Garza | |
| 5,673,848 | A | 10/1997 | Garza | |
| 7,124,890 | B2 | 10/2006 | McLeod et al. | |
| 7,485,083 | B2 | 2/2009 | Gaeta | |
| 7,740,164 | B2 | 6/2010 | McClure | |
| 8,087,569 | B2 | 1/2012 | Ledvina | |
| 9,156,578 | B2 * | 10/2015 | Smith | B65D 1/225 |
| 2004/0256448 | A1 * | 12/2004 | Blomfield | B65D 5/0025 229/174 |

* cited by examiner

*Primary Examiner* — Christopher Demeree
(74) *Attorney, Agent, or Firm* — WestRock IP Legal

(57) ABSTRACT

A blank of sheet material for forming a container includes a bottom panel and two opposing bottom end panels. The blank also includes two opposing side panel assemblies. Each side panel assembly extends from a side edge of the bottom panel. Each side panel assembly includes an outer side panel extending from a side edge of the bottom panel. Two opposing side end panels each extending from an end edge of the outer side panel. A rollover panel extending from a side edge of the outer side panel, two opposing rollover miter panels each extending from an end edge of the rollover panel, and two opposing end rollover panels each extending from an end edge of one of the two opposing rollover miter panels.

20 Claims, 4 Drawing Sheets

CONTAINERS WITH ROLLOVER SIDE WALLS AND REINFORCED CORNERS

BACKGROUND

The field of the present disclosure relates generally to a blank for forming a container and, more particularly, to a blank fabricated from a corrugated paperboard material for forming a container having rollover sides and mitered internal corners.

Containers are frequently utilized to store and aid in transporting products. These containers can be square, hexagonal, or octagonal. Some of these containers are referred to as shipping trays because they are used to ship or transport products for eventual sale. In at least some known cases, a blank of sheet material is used to form a container or tray for transporting a product. More specifically, these known containers are formed by a machine that folds a plurality of panels along fold lines and secures these panels with an adhesive. Such containers may have certain strength requirements for transporting products. These strength requirements may include a stacking strength requirement such that the containers can be stacked on one another during transport without collapsing. To meet these strength requirements, at least some known containers include inserts or increased material thickness for providing additional strength including stacking strength. However, adding such material to containers may increase production time and costs.

BRIEF DESCRIPTION

In one aspect, a blank of sheet material for forming a container is provided. The blank includes a bottom panel and two opposing bottom end panels. Each bottom end panel extends from an end edge of the bottom panel. The blank also includes two opposing side panel assemblies. Each side panel assembly extends from a side edge of the bottom panel. Each side panel assembly includes an outer side panel extending from a side edge of the bottom panel. Two opposing side end panels each extending from an end edge of the outer side panel. A rollover panel extending from a side edge of the outer side panel, wherein the rollover panel is configured to rotate inwardly into a face-to-face relationship with the outer side panel when the container is erected. Two opposing rollover miter panels each extending from an end edge of the rollover panel, wherein the miter panels are configured to obliquely extend from the rollover panel proximate to an interior corner of the container when the container is erected, and two opposing end rollover panels each extending from an end edge of one of the two opposing rollover miter panels.

In another aspect, a shipping and display container formed from a blank of sheet material is provided. The container includes a bottom wall and two opposing side walls. Each side wall includes an outer side panel extending from a side edge of the bottom wall and an adjacent rollover panel extending downwardly from a top edge of the outer side panel. At least one corner reinforcing panel assembly, the at least one corner reinforcing panel assembly includes (i) a rollover miter panel obliquely extending from an end edge of the adjacent rollover panel toward an end wall of the container, and (ii) an end rollover panel extending from the adjacent rollover miter panel, wherein the end rollover panel forms at least a portion of the adjacent end wall.

In another aspect, a method for forming a container from a blank of sheet material is provided. The blank includes a bottom panel, two opposing bottom end panels each extending from an end edge of the bottom panel, and two opposing side panel assemblies each extending from a side edge of the bottom panel. Each side panel assembly includes an outer side panel extending from a side edge of the bottom panel, two opposing side end panels each extending from an end edge of the outer side panel, a rollover panel extending from a side edge of the outer side panel, two opposing rollover miter panels each extending from an end edge of the rollover panels, and two opposing end rollover panels each extending from an end edge of one of the two opposing rollover miter panels. The method includes rotating each rollover panel toward an interior surface of the outer side panel about a fold line connecting each rollover panel and the side panel, wherein said rotating aligns the rollover panel in a substantially face-to-face relationship with the side panel. Rotating each side panel assembly toward an interior surface of the bottom panel about a fold line connecting each side panel assembly and the bottom panel, wherein each side panel assembly is substantially perpendicular to the bottom panel. Rotating each side end panel of the side panel toward an interior surface of the side panel about a fold line connecting each side end panel to the side panel, wherein each side end panel extends substantially along one of the end edges of the bottom panel. Rotating each rollover miter panel and each end rollover panel toward an interior surface of the rollover panel about a fold line connecting the rollover miter panel to the rollover panel and about a fold line connecting the end rollover panel to the rollover miter panel, wherein said rotating aligns the end rollover panel in a substantially face-to-face relationship with the side end panel of the outer side panel, and the rollover miter panel obliquely extends from the rollover panel proximate to an interior corner of the container when the container is erected. The method further includes rotating each bottom end panel toward an interior surface of the bottom panel about a fold line connecting each bottom end panel to the bottom panel, wherein said rotating aligns the bottom end panel in a substantially face-to-face relationship with each side end panel, wherein each the end rollover panel, each side end panel, and the bottom end panel forms an end wall of the container.

DETAILED DESCRIPTION

Figure 1:
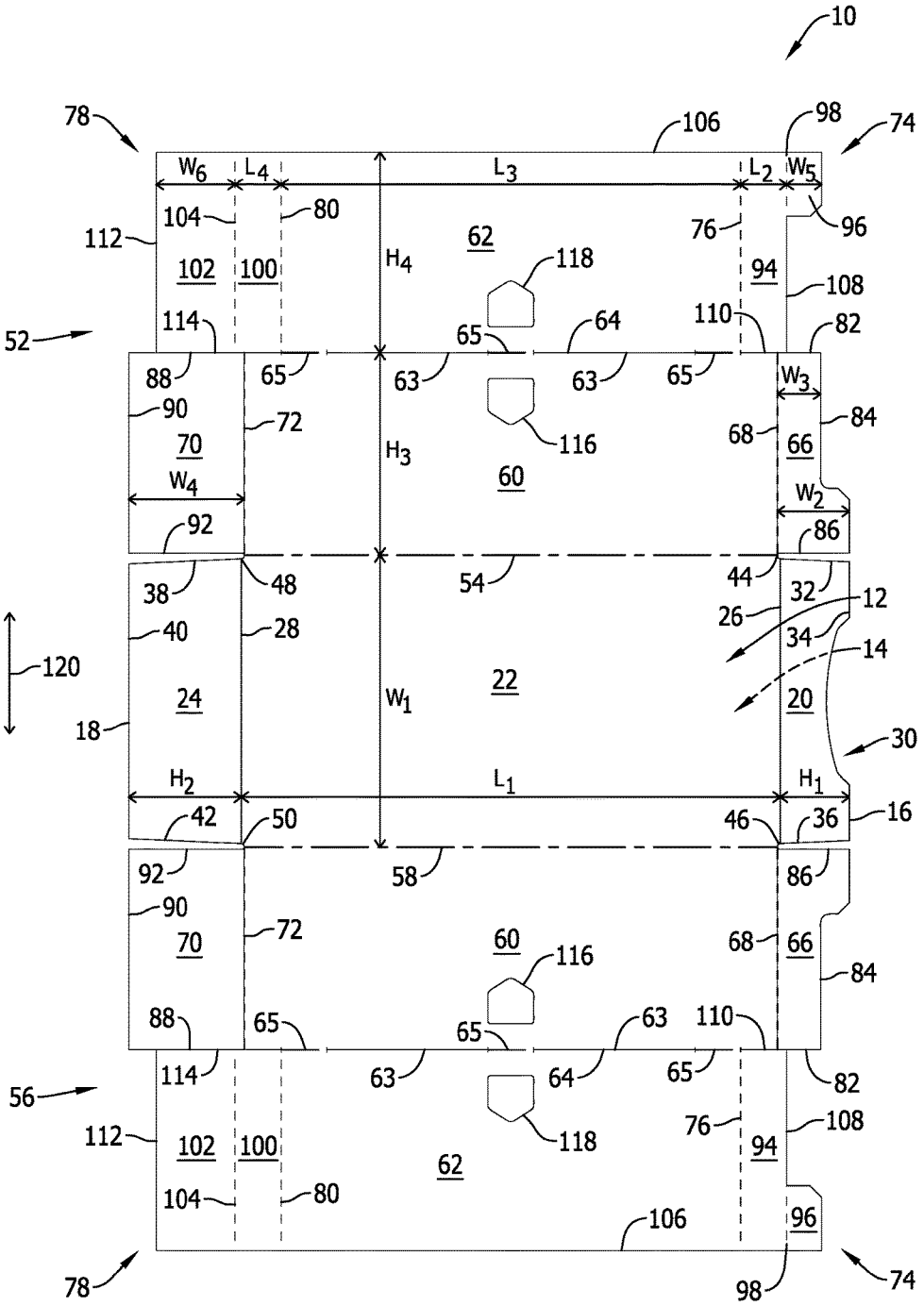
FIG. 1 is a top plan view of an example blank of sheet material for forming a container in accordance with the present disclosure.

The following detailed description illustrates the disclosure by way of example and not by way of limitation. The description clearly enables one skilled in the art to make and use the disclosure, describe several embodiments, adaptations, variations, alternatives, and make use of the disclosure, including what is presently believed to be the best mode of carrying out the disclosure.

Embodiments of the present disclosure provide a stackable shipping and display container including corner reinforcing assemblies with mitered corners, as well as rollover side walls. The container is constructed from a blank of sheet material using a machine and/or by hand. For example, the blank can be wrapped about a mandrel to form a container, or the container can be formed by hand and/or by another style of a tray forming machine. Alternatively, a folder/glue machine can be used to convey the blank through folder arms and an adhesive applicator to form the container. More specifically, the blank may be conveyed through folder arms and an adhesive applicator to form each side wall of the container and each corner reinforcing assembly of the container. The corner reinforcing assemblies may also be formed by a male and female laminator. After forming the side walls and the corner reinforcing assemblies the partially formed container may then be conveyed to a forming station where a mandrel is applied to the inside of the partially formed container to fully form the container. In one embodiment, the container is fabricated from a corrugated paperboard material having a plurality of flutes. The container, however, may be fabricated using any suitable material, and therefore is not limited to a specific type of material. In alternative embodiments, the container is fabricated using cardboard, plastic, fiberboard, paperboard, foam board, corrugated paper, and/or any suitable material known to those skilled in the art and guided by the teachings herein provided.

In an example embodiment, the container includes at least one marking thereon including, without limitation, indicia that communicates the product, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclee, pen and ink, painting, offset lithography, flexography, relief print, rotogravure, dye transfer, and/or any suitable printing technique known to those skilled in the art and guided by the teachings herein provided. In another embodiment, the container is void of markings, such as, and without limitation, indicia that communicates the product, a manufacturer of the product and/or a seller of the product.

Further, in the example embodiment, the container includes corner reinforcing assemblies with mitered corners and side walls formed from an outer side panel and an inner (rollover) side panel. As such, the container can be formed from a single blank of sheet material. Accordingly, the containers described herein do not require separate inserts to form the corner posts. Additionally, the container can be stacked on top of other similarly constructed containers without the upper container nesting (or at least partially falling inside) inside the lower container that it is stacked on. More specifically, the mitered corners and rollover side walls enable the container described herein to be stronger than other known shipping containers that do not include mitered corners and/or rollover side walls, especially with respect to vertical compression strength.

Referring now to the drawings, and more specifically to FIG. 1, which is a top plan view of an example embodiment of a blank 10 of sheet material. A container 200 (shown in FIG. 2) is formed from blank 10. Blank 10 has a first or interior surface 12 and an opposing second or exterior surface 14. Further, blank 10 defines a leading edge 16 and an opposing trailing edge 18. In one embodiment, blank 10 includes, in series from leading edge 16 to trailing edge 18, a first bottom end panel 20 (also referred to as a bottom front side panel), a bottom panel 22, and a second bottom end panel 24 (also referred to as a bottom rear side panel) coupled together along preformed, generally parallel, fold lines 26 and 28, respectively.

More specifically, first bottom end panel 20 extends from leading edge 16 to fold line 26, bottom panel 22 extends from fold line 26 to fold line 28, and second bottom end panel 24 extends from fold line 28 to trailing edge 18. When container 200 is formed from blank 10, fold line 26 defines a bottom edge of first bottom end panel 20 and a first side edge of bottom panel 22, and fold line 28 defines a second side edge of bottom panel 22 and a bottom edge of second bottom end panel 24.

First bottom end panel 20 has a general trapezoidal shape with a generally semi-elliptical shaped recess 30 extending at least partially along leading edge 16. Second bottom end panel 24 has a general trapezoidal shape, and bottom panel 22 has a general rectangular shape. More specifically, first bottom end panel 20 has a height $H_1$, and second bottom end panel 24 has a height $H_2$. First bottom end panel 20 has a height $H_1$ that is greater than height $H_2$. Alternatively, height $H_2$ is substantially equal to, or greater than, height $H_1$. Further, bottom panel 22 has a length $L_1$ and a width $W_1$ defining the overall length and width of container 200 such that length $L_1$ is greater than width $W_1$ forming a rectangle. In an alternative embodiment, width $W_1$ is substantially equal to, or greater than, length $L_1$. Alternatively, first bottom end panel 20, second bottom end panel 24, and/or bottom panel 22 may have any suitable dimensions that enable blank 10 and/or container 200 to function as described herein.

In the exemplary embodiment, first bottom end panel 20 includes three free side edges 32, 34, and 36, and second bottom end panel 24 includes three free side edges 38, 40, and 42. Free side edge 34 is generally co-linear with leading edge 16 and free side edge 40 is generally co-linear with trailing edge 18, which are substantially parallel to each other. Free side edges 32 and 36 terminate at fold line 26 at bottom corners 44 and 46, respectively. Free side edges 38 and 42 terminate at fold line 28 at bottom corners 48 and 50, respectively. Each free side edge 32, 36, 38, and 42 may directly terminate at a respective bottom corner 44, 46, 48, or 50, or as shown in FIG. 1, may be slightly offset from a respective bottom corner 44, 46, 48, or 50 to facilitate forming container 200 from blank 10 by allowing clearance for a thickness of a panel that is directly or indirectly coupled to first bottom end panel 20 or second bottom end panel 24.

Blank 10 includes a first side panel assembly 52 extending from a fold line 54, and an opposite second side panel assembly 56 extending from a fold line 58. Each side panel assembly includes a side panel 60 (also referred to as an outer side panel) extending from bottom panel 22 at fold line 54 or 58 and a rollover panel 62 (also referred to as an inner side panel) extending from outer side panel 60 at a fold line 64. Fold line 64 includes coupling members 65 and scores 63 extending between coupling members 65 which facilitate coupling rollover panel 62 to outer side panel 60 in a substantially face-to-face relationship. When container 200 is formed from blank 10, fold line 54 defines a bottom edge of first side panel assembly 52 and a third side edge of bottom panel 22, and fold line 58 defines a fourth side edge of bottom panel 22 and a bottom edge of second side panel assembly 56.

Further, a first side end panel 66 (also referred to as a first front side panel) extends from outer side panel 60 at a fold line 68, and a second side end panel 70 (also referred to as a first rear side panel) extends from outer side panel 60 at a fold line 72. Side panel assemblies 52 and 56 also include a first corner reinforcing panel assembly 74 extending from rollover panel 62 at a fold line 76, and a second corner reinforcing panel assembly 78 extending from rollover panel 62 at a fold line 80. When container 200 is formed from blank 10, fold line 64 defines a top edge of outer side panel 60 and a top edge of rollover panel 62, and fold lines 54 and 58 define a bottom edge of outer side panel 60. Further, fold line 68 defines a side or corner edge of first side end panel 66 and outer side panel 60, and fold line 72 defines a side or corner edge of outer side panel 60 and second side end panel 70.

First side end panel 66 has a general "L" shape, second side end panel 70 has a general rectangular shape, and outer side panel 60 also has a general rectangular shape. More specifically, first side end panel 66 has a width $W_2$ at a bottom portion greater than a width $W_3$ at a top portion forming a "L" shape. Alternatively, width $W_3$ is substantially equal to, or greater than, width $W_2$. Second side end panel 70 has a width $W_4$ that is less than half width $W_1$. Alternatively, width $W_4$ is substantially half, or greater than half, of width $W_1$. Outer side panel 60 has a height $H_3$ defining the overall height of container 200 and length $L_1$ defining the overall length of container 200. Height $H_3$ is greater than height $H_2$. Alternatively, height $H_3$ is substantially equal to height $H_2$. In an alternative embodiment, first side end panel 66, second side end panel 70, and/or outer side panel 60 may have any suitable dimensions that enable blank 10 and/or container 200 to function as described herein.

In the exemplary embodiment, first side end panel 66 includes three free side edges 82, 84, and 86, and second side end panel 70 includes three free side edges 88, 90, and 92. Free side edge 84 is co-linear with leading edge 16 and free side edge 90 is co-linear with trailing edge 18, which are substantially parallel to each other. Free side edges 82 and 86 at first side end panel 66 are substantially parallel and terminate at fold line 68. Free side edge 86 also terminates at bottom corner 44 or 46. Free side edges 88 and 92 at second side end panel 70 are substantially parallel and terminate at fold line 72. Free side edge 92 also terminates at bottom corner 48 or 50.

Each side panel assembly 52 and 56 also includes rollover panel 62, first corner reinforcing panel assembly 74, and second corner reinforcing panel assembly 78. In the example embodiment, first corner reinforcing panel assembly 74 extends from fold line 76 and includes a first rollover miter panel 94 (also referred to as a miter panel) and a first rollover end panel 96 (also referred to as a second front side panel). First rollover miter panel 94 has a general rectangular shape with a length $L_2$ and a height $H_4$ and extends from fold line 76 to a fold line 98 and leading edge 16. First rollover end panel 96 has a general polygonal shape with an overall width $W_5$ and an overall height $H_4$. Length $L_2$ is greater than width $W_5$. Alternatively, width $W_5$ is substantially equal to, or greater than, length $L_2$. Further, rollover panel 62 has a general rectangular shape with a length $L_3$ and height $H_4$. Length $L_1$ is greater than length $L_3$ and height $H_3$ is greater than height $H_4$. Alternatively, height $H_3$ is substantially equal to height $H_4$.

Further, second corner reinforcing panel assembly 78 extends from fold line 80 and includes a second rollover miter panel 100 (also referred to as a miter panel) and a second rollover end panel 102 (also referred to as a second rear side panel). Second rollover miter panel 100 has a general rectangular shape with a length $L_4$ and a height $H_4$ and extends from fold line 80 to a fold line 104. Second rollover end panel 102 also has a general rectangular shape with a width $W_6$ and an overall height $H_4$. Width $W_6$ is greater than length $L_4$. Alternatively, length $L_4$ is substantially equal to, or greater than, width $W_6$. In an alternative embodiment, first corner reinforcing panel assembly 74, second corner reinforcing panel assembly 78, and/or rollover panel 62 may have any suitable dimensions that enable blank 10 and/or container 200 to function as described herein.

In the exemplary embodiment, first corner reinforcing panel assembly 74 includes three free side edges 106, 108, 110, and second corner reinforcing panel assembly 78 includes three free side edges 106, 112, 114. Free side edge 108 is co-linear with leading edge 16 and free side edge 112 is co-linear with trailing edge 18, which are substantially parallel to each other. Free side edges 106 and 110 are substantially parallel and free side edge 110 terminates at fold line 76. Free side edges 106 and 114 are substantially parallel and free side edge 114 terminates at fold line 80.

Figure 2:
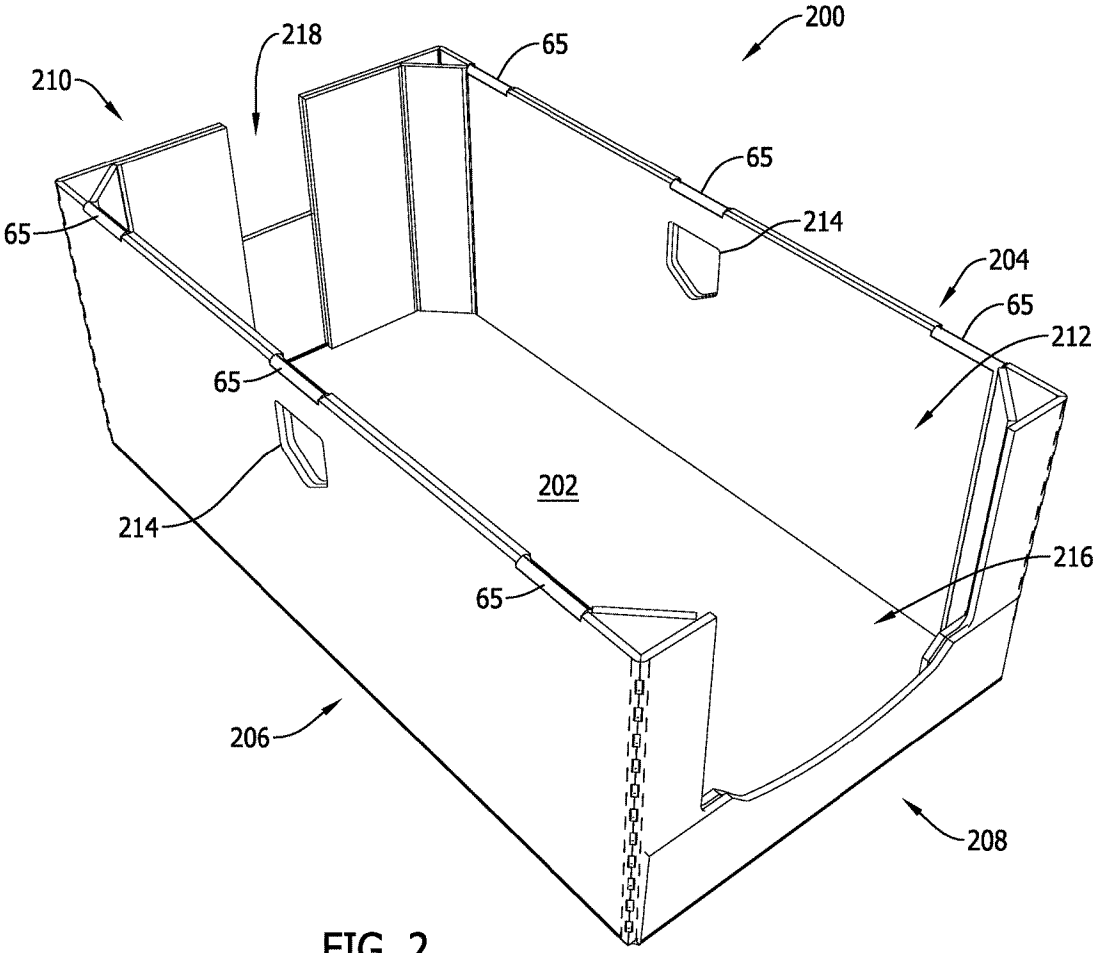
FIG. 2 is a perspective view of an example container formed from the blank shown in FIG. 1.

Further, in the exemplary embodiment, outer side panel 60 includes a hole 116 positioned approximately at the midpoint of length $L_1$ and near fold line 64. Rollover panel 62 also includes a hole 118 that is a mirror image of hole 116 such that when container 200 is formed and rollover panel 62 is folded and aligned with outer side panel 60, holes 116 and 118 align and form an opening 214 on each side wall 204 and 206, as shown in FIG. 2. Holes 116 and 118 are generally polygonal in shape and facilitate receiving tab assembly 326 of a container lid 400 for securing container lid 400 to container 200, as described further below.

As described above, blank 10 may be fabricated from any material that enables container 200 to function as described herein. If a corrugated paperboard material is implemented, such as with a flute B specification or a flute C specification, a direction of corrugation flutes extending along blank 10 is indicated by a double-headed arrow 120 shown in FIG. 1. Although certain lines of weakness (e.g., fold lines, perforation lines, score lines, and cut lines) are shown herein, it should be understood that other lines of weakness can be used and still remain within the scope of the disclosure. For example, fold lines and/or perforation lines described herein, may include any suitable line of weakening and/or line of separation known to those skilled in the art and guided by the teachings herein provided. The lines or weakness shown herein are not intended to be limiting, but rather examples in nature.

FIG. 2 is a perspective view of container 200 formed from blank 10 (shown in FIG. 1). In the example embodiment, container 200 includes a bottom wall 202, first and second opposing side walls 204 and 206, and first and second opposing end walls 208 (also referred to as a front wall) and 210 (also referred to as a rear wall). Each of walls 202, 204, 206, 208 and 210 define a cavity 212 within container 200. Although container 200 is shown as being formed without a product to be contained therein, container 200 may also be formed having a product therein. Further, container 200 may include any suitable number of products of any suitable shape.

Moreover, as will be described in more detail below, each end panel 20, 24, 66, 70, 96, and 102, and each side and rollover panel 60 and 62, cooperate to define at least a double wall thickness for each of walls 204, 206, 208, and 210 around a perimeter of container 200 when formed. As described above, the corrugation flutes extend in a direction indicated by double-headed arrow 120, shown in FIG. 1, such that the corrugation flutes are oriented substantially vertically in the at least double-thick portions of walls 204, 206, 208, and 210 formed by each end panel 66, 70, 96, and 102, and each side and rollover panel 60 and 62, when container 200 is formed.

Container 200 is formed by folding blank 10 along fold lines, perforation lines, and/or score lines. Specifically, first side wall 204 is formed by rotating rollover panel 62 about fold line 64 towards interior surface 12 such that rollover panel 62 is coupled to outer side panel 60 in a substantially face-to-face relationship. As described above, fold line 64 extends between rollover panel 62 and outer side panel 60 and facilitates machine forming container 200. More specifically, fold line 64 via coupling members 65 ensure rollover panel 62 remains connected to outer side panel 60 as rollover panel 62 is rotated about fold line 64. First side panel assembly 52 is then rotated substantially perpendicularly about fold line 54 towards interior surface 12. In the example embodiment, rollover panel 62 and outer side panel 60 are secured in the above-described relationship. For example, rollover panel 62 may be adhered, via adhesive, to outer side panel 60. Second side wall 206 is formed in a substantially similar fashion as described above with second side panel assembly 56 rotated about fold line 58.

After side walls 204 and 206 are formed, first end wall 208 is formed by rotating each first corner reinforcing panel assembly 74 about fold lines 76 and 98 towards interior surface 12, rotating each first side end panel 66 about fold line 68 towards interior surface 12, and rotating first bottom end panel 20 about fold line 26 towards interior surface 12 such that each first rollover end panel 96 is coupled to the respective first side end panel 66 in a substantially face-to-face relationship, and such that each first side end panel 66 is coupled to first bottom end panel 20 in a substantially face-to-face relationship. As described above, fold lines 76, 98, 68, and 26 facilitate machine-forming container 200. More specifically, first bottom end panel 20 is rotated substantially perpendicularly about fold line 26 towards interior surface 12 forming an outer layer of first end wall 208. Each first side end panel 66 is rotated substantially perpendicularly about fold line 68 towards interior surface 12 forming a middle layer of first end wall 208. Each first corner reinforcing panel assembly 74 is rotated about fold lines 76 and 98 such that free side edge 108 generally aligns with free side edge 84 of first side end panel 66. Accordingly, each first rollover end panel 96 is substantially perpendicular to side walls 204 and 206 and forms an inside layer of first end wall 208. Additionally, each first rollover miter panel 94 is rotated such that first rollover miter panel 94 obliquely extends from rollover panel 62 to an interior corner of container 200. More specifically, each first rollover miter panel 94 extends from rollover end panel 96 to rollover panel 62 forming a mitered corner within container 200. In the example embodiment, first bottom end panel 20 and each first side end panel 66 are secured in the above-described relationship. For example, first bottom end panel 20 may be adhered, via adhesive, to each first side end panel 66. Alternatively, first bottom end panel 20 is coupled between each first side end panel 66 and each first rollover end panel 96.

In the exemplary embodiment, the width $W_2$ of each first side end panel 66 is less than half of the overall width $W_1$ of bottom panel 22 and container 200. Additionally, the height $H_1$ of the first bottom end panel 20 is less than the over height $H_3$ of outer side panel 60 and container 200. These dimensions facilitate a window opening 216 at first end wall 208 such that products contained therein are visible within container 200 from first end wall 208. Alternatively, the width $W_2$ of each first side end panel 66 and the height $H_1$ of the first bottom end panel 20 are such that window opening 216 is not formed.

Second end wall 210 is formed by rotating each second corner reinforcing panel assembly 78 about fold lines 80 and 104 towards interior surface 12, rotating each second side end panel 70 about fold line 72 towards interior surface 12, and rotating second bottom end panel 24 about fold line 28 towards interior surface 12 such that each second rollover end panel 102 is coupled to the respective second side end panel 70 in a substantially face-to-face relationship, and such that each second side end panel 70 is coupled to second bottom end panel 24 in a substantially face-to-face relationship. As described above, fold lines 80, 104, 72, and 28 facilitate machine-forming container 200. More specifically, second bottom end panel 24 is rotated substantially perpendicularly about fold line 28 towards interior surface 12 forming an outer layer of second end wall 210. Each second side end panel 70 is rotated substantially perpendicularly about fold line 72 towards interior surface 12 forming a middle layer of second end wall 210. Each second corner reinforcing panel assembly 78 is rotated about fold lines 80 and 104 such that free side edge 112 generally aligns with free side edge 90 of second side end panel 70. Accordingly, each second rollover end panel 102 is substantially perpendicular to side walls 204 and 206 and forms an inside layer of second end wall 210. Additionally, each second rollover miter panel 100 is rotated such that second rollover miter panel 100 obliquely extends from rollover panel 62 to an interior corner of container 200. More specifically, each second rollover miter panel 100 extends from rollover end panel 102 to rollover panel 62 forming a mitered corner within container 200. In the example embodiment, second bottom end panel 24 and each second side end panel 70 are secured in the above-described relationship. For example, second bottom end panel 24 may be adhered, via adhesive, to each second side end panel 70. Alternatively, second bottom end panel 24 is coupled between each second side end panel 70 and each second rollover end panel 102.

In the exemplary embodiment, the width $W_4$ of each second side end panel 70 is less than half of the overall width $W_1$ of bottom panel 22 and container 200. Additionally, the height $H_2$ of the second bottom end panel 24 is less than the overall height $H_3$ of outer side panel 60 and container 200. These dimensions facilitate a window opening 218 at second end wall 210 such that adjacent products and/or containers to second end wall 210 and container 200 are visible from within container 200. Alternatively, the width $W_4$ of each second side end panel 70 and the height $H_2$ of the second bottom end panel 24 are such that window opening 218 is not formed.

Further, in the exemplary embodiment, each corner reinforcing panel assembly 74 and 78 includes rollover miter panels 94 and 100 that form a mitered corner within container 200. The mitered corners facilitate container 200 to be stackable on one another without container lid 400 and without nesting therein. More specifically, container 200 can be stacked on top of other similarly constructed containers such that the mitered corners generally align with one another to provide a stacking area without the upper container nesting (or at least partially falling inside) inside container 200 that it is stacked on. Additionally, the mitered corners facilitate strength within container 200. Each side panel assembly 52 and 56 is formed such that corrugation direction 120 of each panel 60, 62, 66, 70, 94, 96, 100, and 102 extend from bottom wall 202 to the top portion of container 200 such that compressive strength is increased.

The mitered corners and rollover side walls 204 and 206 facilitate container 200 having a compressive strength that allows for at least 17 other full containers to be stacked upon container 200 without additional inserts. Moreover, container 200 formed from blank 10 (shown in FIG. 1) facilitates less fiber use within the material than at least some known containers.

In the exemplary embodiment, container 200 has a material weight within a range from approximately 30% less to approximately 10% less than other known shipping containers. More specifically, container 200 has a material weight of approximately 20% less than other known shipping containers. Additionally, container 200 has a material weight within a range from approximately 10% less to approximately 6% less than other known shipping containers with added inserts. More specifically, container 200 has a material weight of approximately 8% less than other known shipping containers with added inserts.

Figure 3:
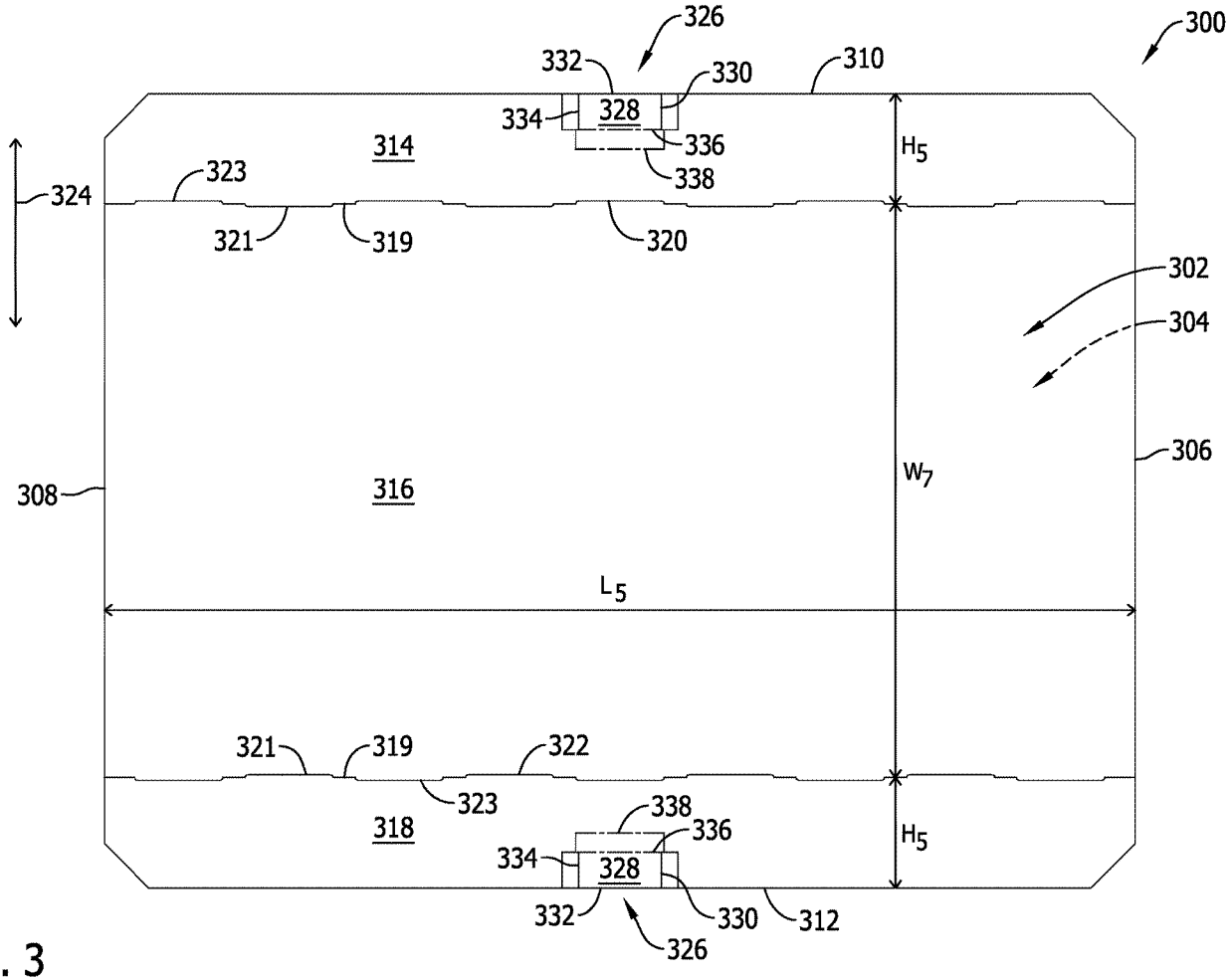
FIG. 3 is a top plan view of an example blank of sheet material for forming a container lid in accordance with the present disclosure.

FIG. 3 is a top plan view of an example embodiment of a blank 300 sheet material. A container lid 400 (shown in FIG. 4) is formed from blank 300. Blank 300 has a first or interior surface 302 and an opposing second or exterior surface 304. Further, blank 300 defines a leading edge 306 and an opposing trailing edge 308, and a first edge 310 and an opposing second edge 312. In the example embodiment, blank 300 includes, in series from first edge 310 to second edge 312, a first side panel 314, a top panel 316, and a second side panel 318 coupled together along preformed, generally parallel, fold lines 320 and 322, respectively.

More specifically, first side panel 314 extends from first edge 310 to fold line 320, top panel 316 extends from fold line 320 to fold line 322, and second side panel 318 extends from fold line 322 to second edge 312. When container lid 400 is formed from blank 300, fold line 320 defines a top edge of first side panel 314 and a first side edge of top panel 316, and fold line 322 defines a second side edge of top panel 316 and a top edge of second side panel 318.

Generally, blank 300 has an octagonal shape. First side panel 314 and second side panel 318 are substantially congruent and have a generally hexagonal shape. Top panel 316 has a rectangular shape. More specifically, first side panel 314 and second side panel 318 have a height $H_5$ that is less than height $H_3$ of outer side panel 60 (shown in FIG. 1). Alternatively, first side panel 314 and second side panel 318 have different heights. Additionally, top panel 316 has a width $W_7$ that is substantially similar to width $W_1$ of bottom panel 22 (shown in FIG. 1) and a length $L_5$ that is substantially similar to length $L_1$ of bottom panel 22. Alternatively, top panel 316 has a different length and width than bottom panel 22. In an alternative embodiment, first side panel 314, second side panel 318, and/or top panel 316 may have any suitable dimensions that enable blank 300 and/or container lid 400 to function as described herein.

As described above, blank 300 may be fabricated from any material that enables container lid 400 to function as described herein. If a corrugated paperboard material is implemented, such as with a flute B specification or a flute C specification, a direction of corrugation flutes extending along blank 300 is indicated by a double-headed arrow 324 shown in FIG. 3.

Further, blank 300 includes at least one tab assembly 326 that facilitates coupling container lid 400 to container 200. Tab assembly 326 is on each side panel 314 and 318 along the first edge 310 and second edge 312, respectively, approximately at the midpoint of length $L_5$ and corresponding to openings 214 (shown in FIG. 2). Each tab assembly includes a foldover panel 328, with three free edges 330, 332, and 334, and extending from each side panel 314 and 318 along two fold lines 336 and 338.

Figure 4:
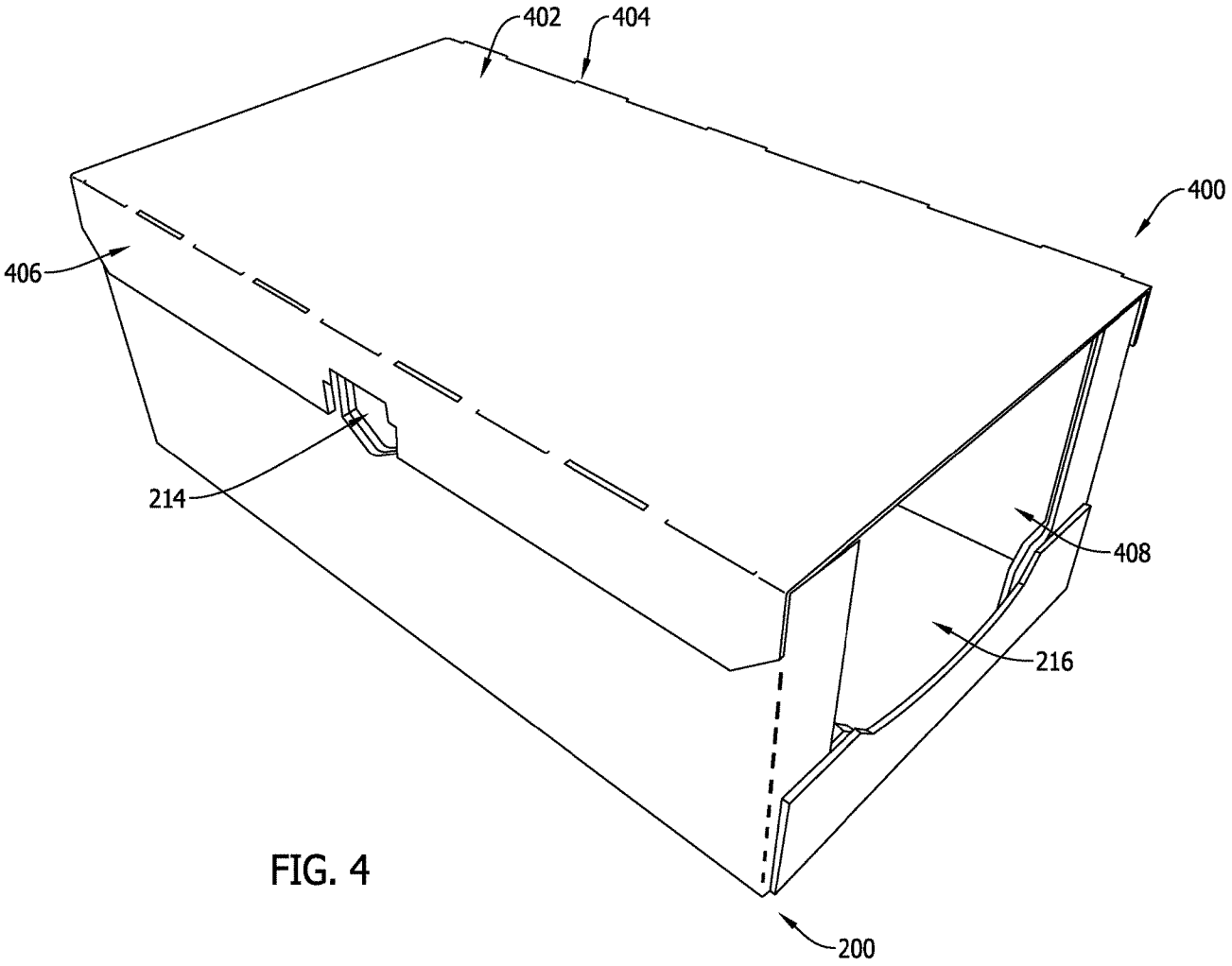
FIG. 4 is a perspective view of the example container shown in FIG. 2 with an example container lid formed from the blank shown in FIG. 3.

FIG. 4 is a perspective view of container 200 (shown in FIG. 2) formed from blank 10 (shown in FIG. 1) with container lid 400 formed from blank 300 (shown in FIG. 3). In the example embodiment, container lid 400 includes a top wall 402 and first and second opposing side walls 404 and 406. Each of walls 402, 404, and 406 define a cavity 408 such that container 200 can fit within.

Container lid 400 is formed by folding blank 300 along fold lines, perforation lines, and/or score lines. Specifically, first side wall 404 is formed by rotating first side panel 314 about fold line 320 towards interior surface 302 such that first side panel 314 is substantially perpendicular to top panel 316. Second side wall 406 is formed in a substantially similar fashion. In the exemplary embodiment fold lines 320 and 322 facilitate maintaining the shape of side walls 404 and 406. Specifically, fold lines 320 and 322 include a fold line 319, a plurality of first score lines 321 cut at an offset distance from fold line 319 into top panel 316, and a plurality of second score lines 323 cut at an offset distance from fold line 319 into first or second side panels 314 and 318. More specifically, each score line 321 and 323 alternates along fold line 319 and is offset approximately a distance equal to half the thickness of the material used for blank 300. When each side wall 404 and 406 is formed, second score line 323 on each side panel 314 and 318 facilitates side panel 314 or 318 to fold under top panel 316, and first score line 321 on top panel 316 facilitates top panel 316 to fold under the remaining extension on each side panel 314 and 318. Alternatively, fold lines 320 and 322 are any other fold line that enables container lid 400 to function as described herein.

Further, container lid 400 is removably coupled to container 200. Specifically, foldover panel 328 folds into opening 214 such that container lid 400 is coupled to container 200. Container lid 400 facilitates container 200 to be stacked or palletized with containers of different shapes and/or sizes. Container lid 400 further does not restrict window openings 216 and 218 allowing products to be on display within container 200 and container lid 400. As described above, the corrugation flutes extend in a direction indicated by double-headed arrow 324, shown in FIG. 3, such that the corrugation flutes are oriented substantially vertically in side walls 404 and 406 formed by each side panel 314 and 318 when container lid 400 is formed.

In the exemplary embodiment, container 200 includes mitered corners and rollover side walls that facilitate increased compressive strength and reduce nesting when stacking, as described further above. Additionally, container lid 400 facilitates container 200 to be stacked or palletized with containers of different shapes and/or sizes. In the exemplary embodiment, container 200 with container lid 400 has a material weight within a range from approximately 8% less to approximately 2% less than other known shipping containers. More specifically, container 200 and container lid 400 has a material weight of approximately 8% less than other known shipping containers. Additionally, container 200 with container lid 400 has compression strength within a range from approximately 260% greater to 200% greater than other known shipping containers. More specifically, container 200 and container lid 400 has compression strength of approximately 230% greater than other known shipping containers. This increase in compression strength and reduction in weight increases the overall efficiency of container 200 when compared to other known shipping containers.

Further, container 200 with container lid 400 has compression strength within a range from approximately 120% greater to 100% greater than other known shipping containers with inserts. More specifically, container 200 and container lid 400 has compression strength of approximately 110% greater than other known shipping containers with inserts. Additionally, container 200 with container lid 400 has a material weight only approximately 8% greater than other known shipping containers. This increase in compression strength with adding a low amount of weight also increases the overall efficiency of container 200 when compared to other known shipping containers with inserts.

Although specific features of various embodiments of the disclosure may be shown in some drawings and not in others, this is for convenience only. In accordance with the principles of the invention, any feature of a drawing may be referenced and/or claimed in combination with any feature of any other drawing.

This written description uses examples to disclose the embodiments of the present disclosure, including the best mode, and also to enable any person skilled in the art to practice embodiments of the present disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blank of sheet material for forming a container, the blank comprising:

a bottom panel;

two opposing bottom end panels, each bottom end panel extending from an end edge of the bottom panel; and two opposing side panel assemblies, each side panel assembly extending from a side edge of the bottom panel, each side panel assembly comprising:

an outer side panel extending from a side edge of the bottom panel;

two opposing side end panels each extending from an opposite end edge of the outer side panel;

a rollover panel extending from a side edge of the outer side panel, wherein the rollover panel is configured to rotate inwardly into a face-to-face relationship with the outer side panel when the container is erected;

two opposing rollover miter panels each extending from an opposite end edge of the rollover panel, wherein the miter panels are configured to obliquely extend from the rollover panel proximate to an interior corner of the container when the container is erected; and two opposing end rollover panels each extending from an end edge of one of the two opposing rollover miter panels;

wherein each side end panel and its associated outer side panel form a right-angle outer corner of the container when the container is erected.

2. The blank in accordance with claim 1, wherein the outer side panel and the rollover panel are configured to define a double wall thickness at a side wall of the container when formed.

3. The blank in accordance with claim 1, wherein the blank is fabricated from a corrugated paperboard material comprising a plurality of flutes extending in a direction such that the plurality of flutes are oriented substantially in a direction perpendicular to the side edge of the bottom panel.

4. The blank in accordance with claim 1, wherein the rollover miter panels are configured to miter an interior corner of the container when the container is erected.

5. The blank in accordance with claim 1, wherein a length of the outer side panel is greater than a length of the rollover panel.

6. The blank in accordance with claim 1, wherein one end rollover panel extends from a portion of one rollover miter panel.

7. The blank in accordance with claim 1 further comprising a second blank, the second blank comprising:

a top panel;

two opposing side panels, each side panel extending from a side edge of the top panel.

8. The blank in accordance with claim 7 further comprising a fold line extending between each side panel and the top panel.

9. A shipping and display container formed from a blank of sheet material, the container comprising:

a bottom wall;

two opposing side walls, each side wall comprising an outer side panel extending from a side edge of the bottom wall and an adjacent rollover panel extending downwardly from a top edge of the outer side panel;

two opposing end walls, and at least one corner reinforcing panel assembly, the at least one corner reinforcing panel assembly comprising (i) a rollover miter panel obliquely extending from an end edge of the adjacent rollover panel toward the adjacent end wall, and (ii) an end rollover panel extending from the adjacent rollover miter panel, wherein the end rollover panel forms at least a portion of the adjacent end wall;

wherein the two opposing end walls and two opposing side walls together form four right-angle outer corners of the container.

10. The container in accordance with claim 9 further wherein each end wall comprises a bottom end panel extending from the bottom wall, two side end panels each extending from an adjacent outer side panel of the two opposing side walls, and two end rollover panels extending from an adjacent rollover panel of the two opposing side walls.

11. The container in accordance with claim 10, wherein the side end panels are coupled between the bottom end panel and the respective end rollover panel.

12. The container in accordance with claim 9, wherein the blank is fabricated from a corrugated paperboard material comprising a plurality of flutes extending in a direction such that the plurality of flutes in the side panels, rollover panels, side end panels, and corner reinforcing panels are oriented substantially vertically relative to the bottom wall.

13. The container in accordance with claim 9, wherein the end rollover panel is configured to align with the corresponding side end panel.

14. The container in accordance with claim 9, wherein the side panel is adhered to the rollover panel in a substantially face-to-face relationship forming each side wall.

15. The container in accordance with claim 9, wherein the bottom end panel is adhered to each side end panel forming each end wall.

16. The container in accordance with claim 9 further comprising a container lid formed from a second blank of sheet material, the container lid comprising:

a top wall; and two opposing lid side walls.

17. The container in accordance with claim 16, wherein the two opposing lid side walls are configured to extend substantially perpendicular to the top wall.

18. The container in accordance with claim 16 wherein the container lid is removably coupled to the container.

19. A method for forming a container from a blank of sheet material, the blank including a bottom panel, two opposing bottom end panels each extending from an end edge of the bottom panel, and two opposing side panel assemblies each extending from a side edge of the bottom panel, wherein each side panel assembly includes an outer side panel extending from a side edge of the bottom panel, two opposing side end panels each extending from an opposite end edge of the outer side panel, a rollover panel extending from a side edge of the outer side panel, two opposing rollover miter panels each extending from an end edge of an opposing rollover panel, and two opposing end rollover panels each extending from an opposite end edge of one of the two opposing rollover miter panels, the method comprising:

rotating each rollover panel toward an interior surface of the outer side panel about a fold line connecting each rollover panel and the side panel, wherein said rotating aligns the rollover panel in a substantially face-to-face relationship with the outer side panel;

rotating each side panel assembly toward an interior surface of the bottom panel about a fold line connecting each side panel assembly and the bottom panel, wherein each side panel assembly is substantially perpendicular to the bottom panel;

rotating each side end panel toward an interior surface of the associated outer side panel about a fold line connecting each side end panel to the outer side panel, wherein each side end panel extends substantially along one of the end edges of the bottom panel;

rotating each rollover miter panel and each end rollover panel toward an interior surface of the rollover panel about a fold line connecting the rollover miter panel to the rollover panel and about a fold line connecting the end rollover panel to the rollover miter panel, wherein said rotating aligns the end rollover panel in a substantially face-to-face relationship with the side end panel of the outer side panel, and the rollover miter panel obliquely extends from the rollover panel proximate to an interior corner of the container when the container is erected; and rotating each bottom end panel toward an interior surface of the bottom panel about a fold line connecting each bottom end panel to the bottom panel, wherein said rotating aligns the bottom end panel in a substantially face-to-face relationship with each side end panel, wherein two of the end rollover panels, two of the side end panels, and one of the bottom end panels form an end wall of the container; wherein each side panel and its associated outer side panel form a right-angle outer corner of the container.

20. The method in accordance with claim 19, further including a second blank including a top panel and two opposing lid side panels, wherein each lid side panel extends from a side edge of the top panel, said method further comprising rotating each lid side panel towards an interior surface of the top panel about a fold line connecting each lid side panel to the top panel, wherein each lid side panel is substantially perpendicular to the top panel.

* * * * *